US009970695B2

(12) United States Patent
Hellmann et al.

(10) Patent No.: US 9,970,695 B2
(45) Date of Patent: May 15, 2018

(54) OIL COMPENSATION IN A REFRIGERATION CIRCUIT

(75) Inventors: Sascha Hellmann, Rheinland-Pfalz (DE); Alexander Tambovtsev, Mainz (DE)

(73) Assignee: CARRIER CORPORATION, Farmington, CT (US)

( * ) Notice: Subject to any disclaimer, the term of this patent is extended or adjusted under 35 U.S.C. 154(b) by 593 days.

(21) Appl. No.: 14/233,197

(22) PCT Filed: Jul. 19, 2011

(86) PCT No.: PCT/EP2011/062356
§ 371 (c)(1),
(2), (4) Date: Jan. 16, 2014

(87) PCT Pub. No.: WO2013/010583
PCT Pub. Date: Jan. 24, 2013

(65) Prior Publication Data
US 2014/0165646 A1 Jun. 19, 2014

(51) Int. Cl.
*F25B 43/02* (2006.01)
*F25B 41/00* (2006.01)

(52) U.S. Cl.
CPC ..... *F25B 43/02* (2013.01); *F25B 41/00* (2013.01); *F25B 2341/0012* (2013.01); *F25B 2400/16* (2013.01)

(58) Field of Classification Search
CPC ..... F25B 31/004; F25B 31/002; F25B 43/02; F25B 41/00; F25B 2400/16; F25B 2341/0012
(Continued)

(56) References Cited

U.S. PATENT DOCUMENTS 2,230,892 A * 2/1941 Haven ..... C09K 5/041 62/113
2,618,132 A * 11/1952 Pottenger, Jr. ..... F25B 43/00 62/125
(Continued)

FOREIGN PATENT DOCUMENTS

DE 123967 A1 1/1977
EP 1705437 A1 9/2006
(Continued)

OTHER PUBLICATIONS

Transmittal of the International Search Report and the Written Opinion of the International Searching Authority for International Application No. PCT/EP20111062356, dated Apr. 5, 2012, 11 pages.

*Primary Examiner* — Len Tran
*Assistant Examiner* — Kirstin Oswald
(74) *Attorney, Agent, or Firm* — Cantor Colburn LLP

(57) ABSTRACT

An oil separation device (14) for separating oil from a refrigerant-oil-mixture in a refrigeration cycle (1), the oil separation device (14) comprises a first refrigerant conduit having at least a first portion (16) with a first diameter (d1); a second refrigerant conduit arranged downstream of and connected to the first refrigerant conduit, the second refrigerant conduit having at least a second portion with a second diameter (d2) being smaller than the first diameter (d1); wherein the second portion (18) of the second refrigerant conduit having the second diameter (d2) extends into the first portion (16) of the first refrigerant conduit forming an oil separation pocket (32) between the outer diameter of the second portion (18) and the inner diameter of the first portion (16); and a suction line (20) having an inlet end (19), which opens into the oil separation pocket (32) and is configured to suck oil from the oil separation pocket (32).

23 Claims, 2 Drawing Sheets

Figure 1:
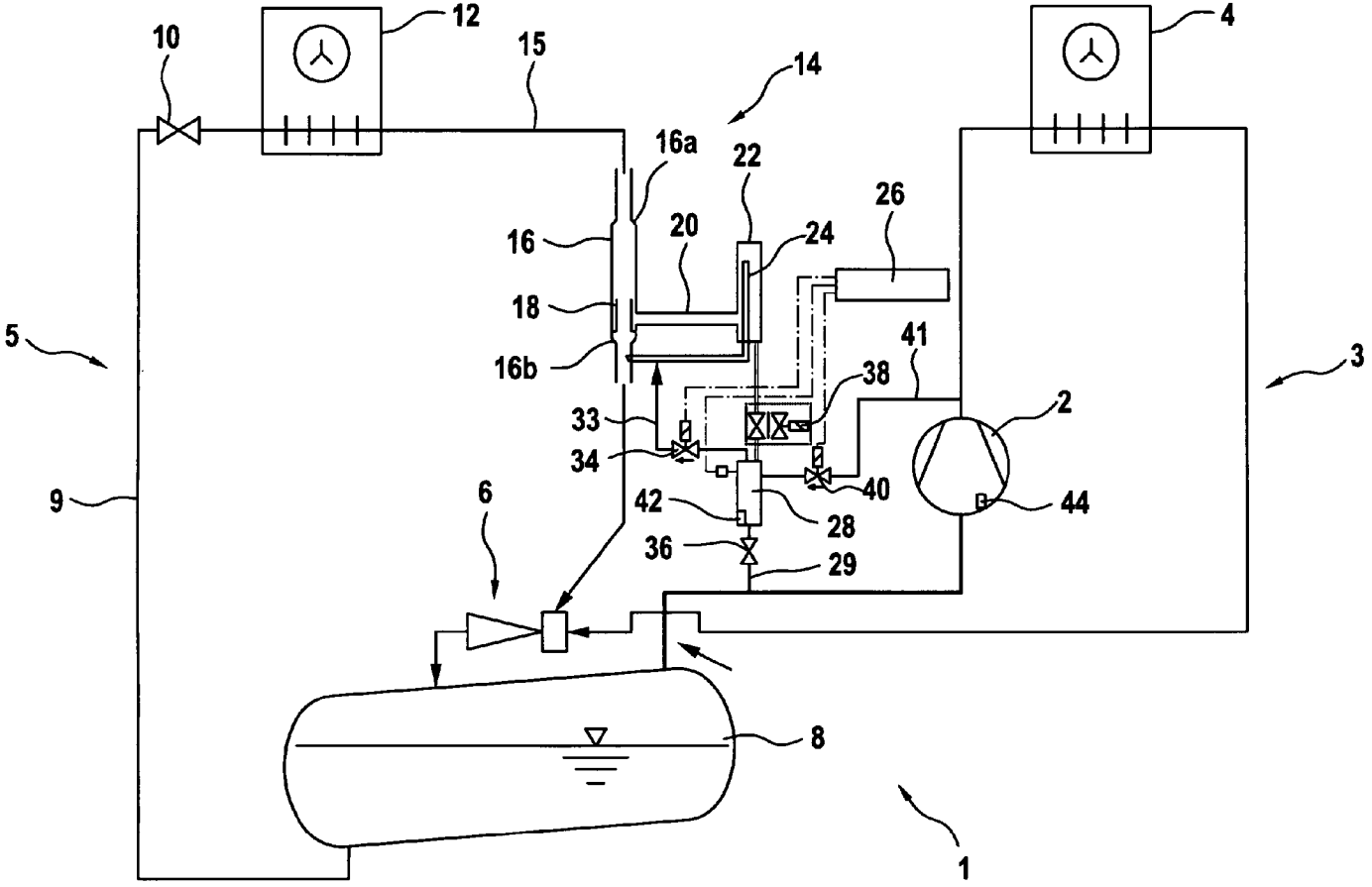

(58) Field of Classification Search
USPC .... 62/470, 84, 192, 193; 137/205, 180, 203, 137/209; 96/155, 196
See application file for complete search history.

(56) References Cited

U.S. PATENT DOCUMENTS

| | | | | | |
|---|---|---|---|---|---|
| 2,882,698 | A * | 4/1959 | Boyle | F25B 41/00 | 415/121.2 |
| 3,067,590 | A * | 12/1962 | Wood, Jr. | F25B 25/005 | 100/155 R |
| 3,167,930 | A * | 2/1965 | Rasovich | F25B 13/00 | 165/62 |
| 3,304,697 | A | 2/1967 | Ramsey | | |
| 3,563,051 | A * | 2/1971 | Baumgartner | F25B 31/002 | 62/468 |
| 3,777,509 | A * | 12/1973 | Muench | F25B 31/004 | 62/192 |
| 3,850,009 | A | 11/1974 | Villadsen | | |
| 3,938,349 | A * | 2/1976 | Ueno | F25B 13/00 | 62/192 |
| 4,039,305 | A * | 8/1977 | Livesay | B01D 19/0031 | 96/219 |
| 4,429,544 | A * | 2/1984 | McCarty | F25B 43/006 | 62/324.1 |
| 4,457,138 | A * | 7/1984 | Bowman | F25B 49/02 | 62/196.1 |
| 4,472,949 | A | 9/1984 | Fujisawa et al. | | |
| 4,558,573 | A * | 12/1985 | La Monica | F04B 39/0207 | 62/473 |
| 4,831,835 | A * | 5/1989 | Beehler | F25B 41/04 | 62/196.1 |
| 5,150,586 | A * | 9/1992 | Basseggio | F16N 19/006 | 417/338 |
| 5,890,374 | A | 4/1999 | Lee | | |
| 6,182,467 | B1 | 2/2001 | Zhong et al. | | |
| 6,574,986 | B2 | 6/2003 | Morimoto et al. | | |
| 6,604,371 | B2 * | 8/2003 | Ueno | F04B 39/0207 | 62/129 |
| 7,086,248 | B2 | 8/2006 | Sakai et al. | | |
| 7,249,467 | B2 | 7/2007 | Nishida et al. | | |
| 2004/0065112 | A1 | 4/2004 | Sakai et al. | | |
| 2005/0028552 | A1 | 2/2005 | Nishijima et al. | | |
| 2008/0173425 | A1 * | 7/2008 | Wiggs | F25B 30/06 | 165/45 |
| 2009/0126376 | A1 | 5/2009 | Knoll | | |
| 2010/0218522 | A1 * | 9/2010 | Cochran | F25B 31/004 | 62/115 |

FOREIGN PATENT DOCUMENTS

| | | | |
|---|---|---|---|
| EP | 2169332 | A2 | 3/2010 |
| JP | 6018127 | A | 1/1994 |
| JP | 11173707 | A | 7/1999 |
| JP | 11257805 | A | 9/1999 |
| JP | 2006125719 | A | 5/2006 |
| KR | 2006132340 | A | 12/2006 |
| WO | 9000709 | A1 | 1/1990 |

* cited by examiner

OIL COMPENSATION IN A REFRIGERATION CIRCUIT

The present invention relates to oil compensation in a refrigeration circuit having an ejector.

The term "ejector circuit" denotes a refrigeration circuit comprising an ejector which is configured for expanding refrigerant coming from a heat rejecting heat exchanger arranged downstream of a compressor and for sucking gas-phase refrigerant from an evaporator at the same time.

The ejector increases the suction pressure of a compressor by converting expansion energy into pressure energy while expanding the refrigerant to a reduced pressure in a vapor compression refrigerating circuit, which transfers heat from the low-temperature side to the high-temperature side.

In a common refrigeration circuit reducing the pressure of the refrigerant by pressure reduction means in an isentropic manner, such as by an expansion valve, the refrigerant flowing out of the expansion valve flows into the evaporator. In the ejector circuit, on the other hand, refrigerant flowing out of the ejector flows into a gas-liquid separator, while liquid-phase refrigerant separated in the gas-liquid separator is supplied to the evaporator and gas-phase refrigerant separated in the gas-liquid separator is drawn into the compressor.

In other words, the common expansion valve circuit represents a single flow of refrigerant where the refrigerant is circulated through a compressor, a condenser, an expansion valve, an evaporator, and the compressor in this order. In contrast to this, in an ejector circuit there are two different flows of refrigerant. One flow allows the refrigerant to circulate through a compressor, a condenser, an ejector, a gas-liquid separator, and the compressor in this order, in the following, such a flow is referred to as a driving flow, while the other allows the refrigerant to circulate through the gas-liquid separator, an evaporator, the ejector, and the gas-liquid separator in this order, in the following, such a flow is referred to as a suction flow.

During operation a fraction of the oil, which is necessary to lubricate the compressor, dissolves into the refrigerant flowing through the compressor leaving the compressor together with the refrigerant. The oil dissolved in the refrigerant accumulates in the liquid portion of the refrigerant collected in the gas-liquid separator, while the gas portion of refrigerant flowing from the gas-liquid separator to the compressor comprises almost no oil.

As a result, the oil level within the compressor decreases and the compressor will run dry after some time of operation. Thus, the oil leaving the compressor together with the refrigerant needs to be replaced in order to prevent the compressor from jamming and being damaged.

Accordingly, it would be beneficial to provide a mechanism for extracting oil from a refrigerant-oil-mixture and for transferring the extracted oil to a compressor.

Exemplary embodiments of the invention include an oil separation device for separating oil from a refrigerant-oil-mixture in a refrigeration cycle, the oil separation device comprising: a first refrigerant conduit having at least a first portion with a first diameter; a second refrigerant conduit arranged downstream of and connected to the first refrigerant conduit, the second refrigerant conduit having at least a second portion with a second diameter being smaller than the first diameter. The second portion having the second diameter extends into the first portion forming an oil separation pocket between the outer diameter of the second portion and the inner diameter of the first portion. The oil separation device further comprises an oil suction line having an inlet end, which opens into the oil separation pocket and which is configured to suck oil from the oil separation pocket.

Exemplary embodiments of the invention further include a refrigeration cycle comprising an oil separation device as described herein and an oil receiver, wherein the oil extraction line connects the separation vessel to the oil receiver.

Figure 2:
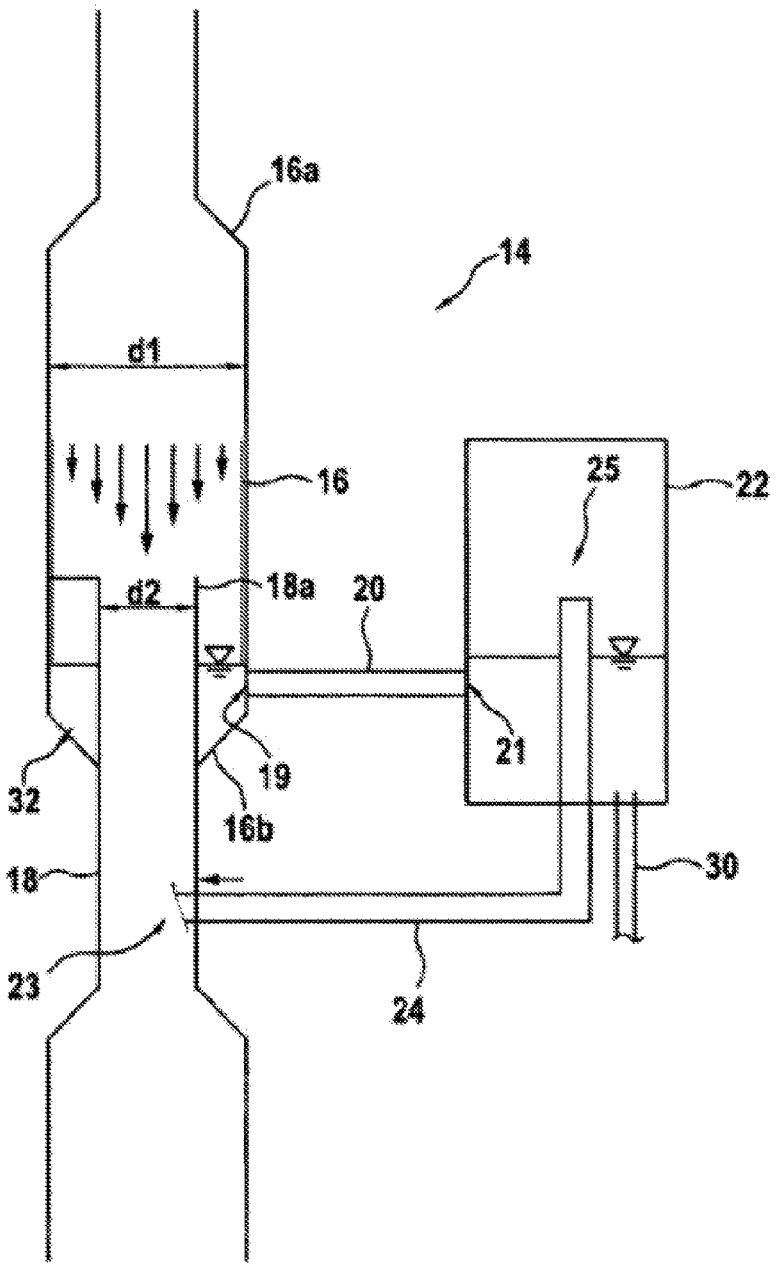

Embodiments of the invention will be described in greater detail below with reference to the enclosed figures, wherein:

FIG. 1 shows a schematic view of a cooling circuit with an ejector and an oil compensation device according to an exemplary embodiment of the invention; and FIG. 2 shows an enlarged detailed view of an oil separation device in accordance with an exemplary embodiment of the invention.

An exemplary refrigeration circuit 1 with an ejector 6 as it is shown in FIG. 1 comprises a refrigerant receiver 8, which operates as liquid-gas-separator and which is part of a driving circuit 3 operating at high pressure as well as of a suction circuit 5 operating at low pressure.

The driving circuit 3 comprises a compressor 2 fluidly connected to an upper portion of the refrigerant receiver 8 in order to suck, in operation, gaseous refrigerant, which accumulates in the upper portion of the refrigerant receiver 8, from the refrigerant receiver 8. Said gaseous refrigerant is compressed by the compressor 2 to a high pressure of e.g. 90-95 bar and supplied to a heat rejecting heat exchanger 4 (condenser) where it is cooled by transferring heat from the refrigerant to the environment.

The refrigerant leaving the heat rejecting heat exchanger 4 is expanded to an intermediate pressure of e.g. 35 bar by an ejector 6 arranged downstream of the condenser 4, and the expanded refrigerant is fed back into the receiver 8 closing the driving circuit 3.

The suction circuit 5 operates at a lower pressure level than the driving circuit 3 and comprises a refrigerant line 9 connected to a lower portion of the refrigerant receiver 8 in order to supply liquid refrigerant, which collects at the bottom of the refrigerant receiver 8, to an expansion device 10. The expansion device 10 expands the liquid refrigerant from the intermediate pressure of e.g. 35 bar, which is present within the refrigerant receiver 8, to a low pressure of e.g. 28 bar. The expanded refrigerant coming from the expansion device 10 flows into a heat receiving heat exchanger 12 (evaporator), which evaporates the refrigerant by absorbing heat from the heat receiving heat exchanger 12. The heat receiving heat exchanger 12 may act as a heat sink in a refrigeration application, as e.g. a refrigerating furniture, an air conditioner, etc.

The outlet of the evaporator 12 is fluidly connected to a second inlet of the ejector 6. The ejector 6 is configured in a way that the flow of the high-pressure refrigerant circulating within the driving circuit 3 and entering into the ejector 6 via its first inlet sucks the low-pressure refrigerant from the evaporator 12 into the ejector 6, thereby driving the fluid flow within the suction circuit 5. The refrigerant from the driving circuit as well as from the suction circuit coming from the evaporator 12 is delivered to the refrigerant receiver 8, where it is separated into the gas phase and the liquid phase.

Thus, the ejector 6 and the refrigerant receiver 8 connect the driving circuit 3 and the suction circuit 5 to each other and allow for an undesirable transfer of oil from the driving circuit to the suction circuit:

Oil dissolves in the liquid phase of refrigerant much more than in the gas phase of the refrigerant. Thus, oil, which is used for lubricating the compressor 2 and which has dissolved into the refrigerant leaving the compressor 2 will accumulate in the liquid portion of the refrigerant collected within the refrigerant receiver 8 and circulate together with the liquid refrigerant in the suction circuit 5. This results in a loss of oil within the driving circuit 3 so that the compressor 2 will run dry if the oil transferred from the driving circuit 3 to the suction circuit 5 is not sufficiently replaced.

In order to re-transfer oil from the refrigerant circulating in the suction circuit 5 to the driving circuit 3 and in particular to the compressor 2, an oil separation device 14 according to an exemplary embodiment of the invention is arranged in the suction circuit 5 between the outlet of the evaporator 12 and the inlet of the ejector 6.

The oil separation device 14, which is shown at larger scale in more detail in FIG. 2, comprises a first portion 16 of a first refrigerant conduit having an enlarged diameter d1 compared to the diameter of the refrigerant conduit 15 connected to the outlet of the evaporator 12 and a second portion 18 of a second refrigerant conduit having a diameter d2 which is smaller than the diameter d1 of the first portion 16. The second portion 18 is arranged downstream of the first portion 16 and extends coaxially into a central part of the first portion 16. A downstream end 16*b* of the first portion 16 is sealingly connected to the outer periphery of the second portion 18 forming an oil separation pocket 32 between the first portion 16 and the second portion 18, said oil separation pocket 32 being defined by the outer diameter of the second portion 18 and the inner diameter of the first portion 16.

As the velocity of the refrigerant flow within the conduit decreases in radial direction from the center of the conduit to its outer periphery, a substantial portion of the oil comprised in the circulating refrigerant accumulates at the side wall(s) of the first portion 16, when the oil comprising refrigerant enters into the enlarged first portion 16. The oil accumulates at the outer periphery of the first portion 16 and the central part of the refrigerant flow entering into the second portion 18, which is arranged at a central part of the first portion 16 and has a smaller diameter than the first portion 16, comprises considerably less oil than the refrigerant entering into the first portion 16.

The minimum length of the enlarged first portion 16 in direction of the flow is defined by the minimum distance of flow necessary for providing a satisfactory oil separation. The distance between an upstream end 16*a* of the enlarged first portion 16 and an upstream end 18*a* of the second portion 18 may for example be in the range of 0.25 m to 1 m, and in particular 0.5 m.

In order to transfer oil, which has been collected in the oil separation pocket 32 formed between the first and second portions 16, 18, from said oil separation pocket 32, an inlet end 19 of an oil suction line 20 opens into said oil separation pocket 32. An outlet end 21 arranged at the opposing end of the oil suction line 20 opens into an oil separation vessel 22 arranged close to the first and second portions 16, 18.

Oil, which has been collected in the oil separation pocket 32, may flow by means of gravity from the oil separation pocket 32 to the oil separation vessel 22 if the outlet end 21 of the oil suction line 20 is arranged at a lower level than the inlet end 19 of the oil suction line 20.

Alternatively or additionally the oil may be sucked via the oil suction line 20 from the oil separation pocket 32 into the oil separation vessel 22 by reducing the pressure within the oil separation vessel 22 to a value below the pressure within the oil separation pocket 32.

This pressure reduction is achieved by means of a low-pressure refrigerant return line 24 having an inlet end 25, which opens into a middle or upper portion of the oil separation vessel 22. In particular, the low-pressure refrigerant return line 24 is oriented vertically within the oil separation vessel 22 with its outlet end 25 being arranged at its top above the level of oil collected within the oil separation vessel 22, in order to avoid that oil is sucked into the low-pressure refrigerant return line 24.

An outlet end 23 arranged at an opposing end of the low-pressure refrigerant return line 24 opens into the second refrigerant line at a position located downstream of the first portion 16. The flow of refrigerant flowing by the inlet end 23 of the low-pressure refrigerant return line 24 in the second refrigerant line causes a flow from the low-pressure refrigerant return line 24 into the second refrigerant line reducing the pressure within the low-pressure refrigerant return line 24 and the oil separation vessel 22 below the pressure within the oil separation pocket 32. This pressure difference between the oil separation vessel 22 and the oil separation pocket 32 causes oil and refrigerant comprising a large fraction of oil, which has been collected in the oil separation pocket 32, to flow from the oil separation pocket 32 through the oil suction line 20 into the oil separation vessel 22. In order to increase the reduction of pressure within the low-pressure refrigerant return line 24, the outlet end 23 of the low-pressure refrigerant return line 24 located in the second portion 18 is oblique with respect to the direction of the refrigerant-flow within the second refrigerant line.

Due to gravity the oil comprised in the refrigerant-oil-mixture, which has been sucked from the oil separation pocket 23 and entered the oil separation vessel 22, collects at the bottom of the oil separation vessel 22, whereas gaseous refrigerant sucked from the oil separation pocket 23 collects in an upper portion of the vessel 22. The gaseous refrigerant is sucked from the upper portion of the separation vessel 22 into the second refrigerant line via the low-pressure refrigerant return line 24.

An oil extraction line 30 fluidly connects the bottom of the oil separation vessel 22 to an oil receiver 28, which is arranged at a level below the oil separation vessel 22. The oil extraction line 30 allows to transfer oil, which has been collected at the bottom of the oil separation vessel 22, from the oil separation vessel 22 to the oil receiver 28.

As a result, the oil portion comprised in the refrigerant-oil-mixture circulating within the suction circuit 5 may be separated from the refrigerant portion, and the separated oil is collected in the oil receiver 28 for further use.

A restricting device, which may be a switchable valve, a one-way-valve or an orifice 38 is arranged in the oil extraction line 30 connecting the oil separation vessel 22 to the oil receiver 28.

The oil receiver 28 is further connected to a couple of lines 29, 33, 41, each of said lines being provided with a switchable valve 36, 40, 34 allowing to control the transfer of oil to and from the oil receiver 28 by opening and closing the switchable valves 36, 40, 34 as described in detail below.

An oil receiver venting line 33 comprising a switchable venting valve 34 fluidly connects the oil receiver 28 to the low-pressure refrigerant return line 24. By opening the venting valve 34 and connecting the oil receiver 28 to the low-pressure refrigerant return line 24 the pressure within the oil receiver 28 is reduced in order to support the flow of oil from the oil separation vessel 22 via the oil extraction line 30 into the oil receiver 28. Thus, the oil venting valve 34 will be opened for collecting oil within the oil receiver 28.

The oil receiver 28 is fluidly connected to the high-pressure outlet side of the compressor 22 by a high-pressure line 41 comprising a switchable high-pressure valve 40. The oil receiver 28 is further fluidly connected to the low-pressure inlet side of the compressor 2 via an oil supply line 29 comprising a switchable oil supply valve 36.

For transferring oil, which has been separated from the refrigerant-oil-mixture circulating in the suction circuit 5 and which has been collected in the oil receiver 28 as it has been described before, from the oil receiver 28 to the compressor 2, the oil venting valve 34 arranged in the oil receiver venting line 33 connecting the oil receiver 28 to the low-pressure refrigerant return line 24 is closed and the oil supply valve 36 arranged within the oil supply line 29 is opened.

When the oil supply valve 36 is open, oil from the oil receiver 28 may flow through the oil supply line 29 to the compressor 2 increasing the oil level within the compressor 2. Said flow of oil may be supported and enhanced by increasing the pressure within the oil receiver 28. In order to increase the pressure within the oil receiver 28, the oil receiver 28 is fluidly connected to the high-pressure outlet side of the compressor 2 via the high-pressure line 41 by opening the high-pressure valve 40. The restricting device 38, which is arranged in the oil extraction line 30, avoids that the increased pressure in the oil receiver 28 immediately equalizes via the oil extraction line 30 into the oil separation vessel 22.

The switchable valves 34, 36, 40 are connected to a control unit 26 which is configured for controlling the valves 34, 36, 40 in order to switch between the two modes of operation, which have been described before, namely an oil collection mode in which oil is extracted from the refrigerant-oil-mixture circulating within the suction circuit 5 and collected within the oil receiver 28, and an oil supply mode in which the oil, which has been collected in the oil receiver 28 is transferred from the oil receiver 28 to the driving circuit 3 and in particular to the compressor 2 of the driving circuit 3.

The oil receiver 28 and/or the compressor 2 are provided with oil sensors 42, 44 in order to respectively sense the level of oil in the receiver 28 or the compressor 2. Knowing the oil level within the receiver 28 and/or the compressor 2 allows to switch between the oil collection mode and the oil supply mode based on said oil levels. In particular, the control 26 may switch from the oil collection mode to the oil supply mode if the oil level within the compressor 44 falls below a predetermined minimum oil level and/or if the oil level within the oil receiver 28 increases above a predetermined maximum oil level.

Alternatively or additionally it is possible to switch from the oil collection mode to the oil supply mode after a predetermined time of operation has expired. If the switching is trigged based only on the time of operation and not on the level of oil in the receiver 28 and/or the compressor 2 no oil sensors 42, 44 are necessary. This reduces the costs for manufacturing and maintaining the refrigeration circuit 1.

The exemplary embodiment of a refrigeration circuit 1 shown in FIG. 1 comprises only one compressor 2, one expansion device 10, one evaporator 12 and one heat rejecting heat exchanger (condenser) 4. It is, however, self-evident to the skilled person that the refrigeration circuit may comprise a plurality of compressors 2, expansion devices 10, evaporators 12 and/or heat rejecting heat exchangers 4, as well.

The exemplary embodiment of a refrigeration circuit 1 shown in FIG. 1 is a subcritical refrigeration circuit in which the refrigerant is liquefied within the heat rejecting heat exchanger 4. An oil separation device as described herein, however, may also be used in a transcritical refrigeration circuit in which the refrigerant, e.g. $CO_2$, is not liquefied, as well.

It is to be noted that no additional moving elements as e.g. pumps are necessary for separating the oil from the refrigerant. The oil is separated from the refrigerant-oil-mixture by supplying the refrigerant-oil-mixture to a portion of the refrigerant conduit 15 having an enlarged cross section and collecting the oil fraction of the refrigerant in an oil separation pocket 32 formed at the outer periphery of the conduit 15. A pressure difference is generated by means of a low-pressure refrigerant return line 24 using the refrigerant flow itself for extracting the separated oil from the separation pocket 32.

In an oil separation device for separating oil from a refrigerant-oil-mixture in a refrigeration cycle according to exemplary embodiments of the invention, oil flows at the wall of the first refrigerant conduit as a ring current, and, due to a decline in pressure, oil flows through the oil suction line from the oil separation pocket to the separation vessel, and separated oil will leave the separation vessel by the oil extraction line and is collected in an oil receiver for future use. Remaining refrigerant will flow via the low-pressure refrigerant return line back to the second refrigerant conduit.

An oil separation device for separating oil from a refrigerant-oil-mixture in a refrigeration cycle according to exemplary embodiments of the invention, provides for an efficient oil separation, especially in ejector cycles. Here, oil is accumulated in the evaporator circuit because the vapor sucked by the compressor from the receiver/collecting container is almost free of oil while the compressor nevertheless loses oil during operation. It is sufficient to replace the oil collected every now and then by using the oil collected in the oil receiver. An oil separation device for separating oil from a refrigerant-oil-mixture in a refrigeration cycle according to exemplary embodiments of the invention, is cheaper, can easily be manufactured using simple basic components and needs less space.

An oil separation device may comprise a low-pressure refrigerant return line having an outlet end, which opens into the second portion with the smaller diameter of the refrigerant conduit and which is configured to reduce the pressure in the oil suction line. Such a low-pressure refrigerant return line allows to provide a reduced pressure for sucking oil from the oil separation pocket without using an additional pump thereby saving the costs for providing and operating such an additional pump.

The outlet end of the low-pressure refrigerant return line may open into the second portion with the smaller diameter at a position downstream of the oil separation pocket in order to provide an effective pressure reduction in the low-pressure refrigerant return line.

The outlet end of the low-pressure refrigerant return line may extend into the second refrigerant conduit in order to enhance the pressure reduction.

The portion of the outlet end of the low-pressure refrigerant return line which extends the farthest into the second refrigerant conduit may be oblique. An oblique end enhances the drop of pressure caused in the low-pressure refrigerant return line by the fluid passing by the end.

The oil separation device may comprise a separation vessel, wherein an inlet end of the oil suction line opens into said separation vessel. An operating vessel allows to further separate the oil fraction from the refrigerant fraction of the refrigerant-oil-mixture.

The outlet end of the oil suction line may be arranged at a side-wall of the oil separation vessel for delivering fluid sucked from the oil separation pocket into the oil separation vessel. Fluid entering the oil separation vessel from the side allows an efficient separation of the oil fraction from the refrigerant fraction of the fluid.

An inlet end of the low-pressure refrigerant return line may open into the separation vessel in order to allow to reduce the pressure within the separation vessel. Reducing the pressure in the separation vessel allows to suck fluid, which has been collected within the oil separation pocket, into the separation vessel.

The inlet end of the low-pressure refrigerant return line opens into an upper or middle part of the separation vessel. This allows to reduce the pressure within the separation vessel by sucking gaseous refrigerant from the separation vessel without sucking oil, which usually collects at the bottom of the separation vessel, into the low-pressure refrigerant return line and back to the refrigerant circulating within the suction circuit.

The oil separation device may comprise an oil extraction line connected to a bottom part of the separation vessel for extracting oil form the separation vessel.

Exemplary embodiments of the invention also comprise a refrigeration cycle with an oil separation device as described before and an oil receiver, wherein the oil extraction line fluidly connects the separation vessel to the oil receiver allowing to collect and store the oil separated by the separation vessel within the oil receiver for further use.

The refrigeration cycle may comprise a switchable valve, a one-way-valve or an orifice arranged in the oil extraction line connecting the separation vessel to the oil receiver in order to avoid that an increased pressure, which has been generated in the oil receiver, equalizes via the oil extraction line into the separation vessel.

The refrigeration cycle may comprise an oil receiver venting line connecting the oil receiver to the low-pressure refrigerant return line. By connecting the oil receiver to the low-pressure refrigerant return line, the pressure within the oil receiver may be reduced in order to enhance the flow of oil from the separator vessel into the oil receiver.

Exemplary embodiments of the invention also include a refrigeration cycle comprising a compressor having a low-pressure inlet and a high-pressure outlet; a condenser; an ejector; a receiver; and an evaporator. An oil separation device, which is configured as it has been described before, is arranged in a refrigerant conduit between the evaporator and the ejector for transferring oil back to the compressor in order to compensate a loss of oil which occurs when the compressor is operating and oil dissolves into the refrigerant flowing through the compressor.

The refrigeration cycle may comprise an oil supply line connecting the oil receiver to the low-pressure inlet side of the compressor. Such an oil supply line allows to transfer oil from the oil receiver to the compressor for compensation of a loss of oil which occurs when the compressor is operating.

The refrigeration cycle may comprise a high-pressure line connecting the oil receiver to the high-pressure outlet side of the compressor. Such a high-pressure line allows to connect the oil receiver to the high-pressure outlet side of the compressor increasing the pressure within the oil receiver in order to support the transfer of oil from the oil receiver to the compressor. Providing increased pressure by the oil receiving compressor allows to support the flow of oil into the compressor without an additional pressure generating device.

The refrigeration cycle may comprise at least one switchable valve arranged in the oil receiver venting line, the oil supply line and/or in the high-pressure line, respectively. Switchable valves respectively arranged in the oil receiver venting line, the oil supply line and/or in the high-pressure line allow to selectively increase and decrease the pressure within the oil collector by opening and closing the valves connecting the oil receiver to the high-pressure outlet side or the low-pressure inlet side, respectively, in order to support the transfer of oil from the separation vessel into the oil receiver and from the oil receiver to the compressor.

The refrigeration cycle may further comprise a control unit for controlling the switchable valves in order to selectively support the transfer of oil from the separation vessel to the oil receiver and/or from the oil receiver to the compressor.

The refrigeration cycle may comprise at least one sensor for sensing the amount of oil in the oil receiver and/or in the compressor in order to allow the control unit to control the transfer of oil to and from the oil receiver based on the level of oil within the oil receiver and/or the compressor.

The control unit may be configured to open the valve in the oil receiver venting line and to close the valves in the high-pressure line and the oil supply line in normal operation in order to collect oil in the oil receiver.

The control unit may be configured to close the venting valve in the oil receiver venting line and to open the high-pressure valve in the high-pressure line and the oil supply valve in the oil supply line, when a sensor senses that the amount of oil stored in the oil receiver exceeds an upper limit and/or that the amount of oil in the compressor has dropped below a lower limit, in order to supply oil from the oil receiver to the compressor. This provides an effective oil compensation preventing the compressor from running out of oil.

While the invention has been described with reference to exemplary embodiments, it will be understood by those skilled in the art that various changes may be made and equivalence my be substitute for elements thereof without departing from the scope of the invention. In addition, modifications may be made to adapt a particular situation or material to the teachings of the invention without departing from the essential scope thereof. Therefore, it is intended that the invention is not limited to the particular embodiments disclosed, but that the invention will include all embodiments falling within the scope of the pendent claims.

REFERENCE NUMBERS

1 refrigeration cycle
2 compressor
3 driving circuit
4 heat rejecting heat exchanger (condenser)
5 suction circuit
6 ejector
8 refrigerant receiver
10 expansion device
12 heat receiving heat exchanger
14 oil separation device
16 first portion of a first refrigerant conduit
**16*a*** upstream end of the first portion
**16*b*** downstream end of the first portion
18 second portion of a second refrigerant conduit
**18*a*** upstream end of the second portion
**18*b*** downstream end of the second portion
19 inlet end of the oil suction line
20 oil suction line

21 outlet end of the oil suction line
22 separation vessel
23 outlet end of the refrigerant return line
24 refrigerant return line
25 inlet end of the refrigerant return line
26 control unit
28 oil receiver
29 oil supply line
30 oil extraction line
32 oil separation pocket
33 oil receiver venting line
34 venting valve
36 oil supply valve
38 restricting device
40 high-pressure valve
41 high-pressure line
42, 44 oil sensors

The invention claimed is:

1. An oil separation device for separating oil from a refrigerant-oil-mixture in a refrigeration cycle, the oil separation device comprising:

a first refrigerant conduit having at least a first portion with a first diameter;

a second refrigerant conduit arranged downstream of and connected to the first refrigerant conduit, the second refrigerant conduit having at least a portion with a second diameter which is smaller than the first diameter;

wherein the portion having the second diameter extends into the first portion;

an oil suction line having an inlet end, which opens into the oil separation pocket, and being configured to suck oil from the oil separation pocket; and a separation vessel, wherein an outlet end of the oil suction line opens into the separation vessel;

wherein an upstream end of the portion having the second diameter is arranged within the first portion and comprises an opening fluidly connecting a central part of the portion having the second diameter with the first portion allowing a central part of refrigerant flowing through the first portion to enter into the portion having the second diameter; and wherein a downstream end of the first portion is sealingly connected to the outer periphery of the portion having the second diameter forming an oil separation pocket between the outer diameter of the portion having the second diameter and the inner diameter of the first portion.

2. The oil separation device of claim 1, further comprising a low-pressure refrigerant return line with an outlet end which opens into the second refrigerant conduit.

3. The oil separation device of claim 2, wherein the outlet end of the low-pressure refrigerant return line opens into the portion with the smaller diameter.

4. The oil separation device of claim 2, wherein the outlet end of the low-pressure refrigerant return line opens into the second refrigerant conduit at a position downstream of the oil separation pocket.

5. The oil separation device of claim 2, wherein the outlet end of the low-pressure refrigerant return line extends into the second refrigerant conduit.

6. The oil separation device of claim 2, wherein the outlet end of the low-pressure refrigerant return line is oblique with the portion of the outlet end that extends the farthest into the second refrigerant conduit being located in an upstream direction.

7. The oil separation device of claim 1, wherein the outlet end of the oil suction line is arranged at a side-wall of the separation vessel.

8. The oil separation device of claim 1, wherein the outlet end of the oil suction line is arranged at a level above the bottom of the separation vessel, such that oil collects at the bottom of the separation vessel.

9. The oil separation device of claim 2, wherein an inlet end of the low-pressure refrigerant return line opens into the separation vessel.

10. The oil separation device of claim 9, wherein the inlet end of the low-pressure refrigerant return line opens into the separation vessel at a middle or upper level thereof.

11. The oil separation device of claim 1, further comprising an oil extraction line connected to a bottom part of the separation vessel.

12. A refrigeration cycle comprising the oil separation device of claim 11 and an oil receiver, wherein the oil extraction line connects the separation vessel to the oil receiver.

13. The refrigeration cycle of claim 12, further comprising an oil valve or orifice arranged in the oil extraction line connecting the separation vessel to the oil receiver.

14. The refrigeration cycle of claim 13, wherein the oil valve is a one-way-valve or a solenoid valve.

15. The refrigeration cycle of claim 12, further comprising an oil receiver venting line connecting the oil receiver to the low-pressure refrigerant return line.

16. The refrigeration cycle of claim 12, further comprising:

a compressor having a low-pressure inlet and a high-pressure outlet;

a condenser;

an ejector;

a refrigerant receiver; and an evaporator;

wherein the oil separation device is arranged in a refrigerant conduit between the evaporator and the ejector.

17. The refrigeration cycle of claim 16, further comprising an oil supply line connecting the oil receiver to the inlet of the compressor or to a suction line leading to the compressor.

18. The refrigeration cycle of claim 16, further comprising a high-pressure line connecting the oil receiver to a pressure line of the compressor.

19. The refrigeration cycle of claim 14, further comprising at least one switchable valve arranged in the oil receiver venting line, the oil supply line and/or in the high-pressure line.

20. The refrigeration cycle of claim 19, further comprising a control unit for controlling the switchable valves.

21. The refrigeration cycle of claim 20, further comprising at least one sensor for sensing the amount of oil in the oil receiver and/or in the compressor.

22. The refrigeration cycle of claim 20, wherein the control unit is configured to open the venting valve in the oil receiver venting line and to close the valves in the high-pressure line and the oil supply line in normal operation in order to collect oil in the oil receiver.

23. The refrigeration cycle of claim 21, wherein the control unit is configured to close the venting valve in the oil receiver venting line and to open the valves in the high-pressure line and the oil supply line, if the sensor senses that the amount of oil in the oil receiver exceeds an upper limit and/or that the amount of oil in the compressor has dropped below a lower limit in order to supply oil from the oil receiver to the compressor.

* * * * *